United States Patent [19]

Caragliano et al.

[11] B 3,999,150

[45] Dec. 21, 1976

[54] MINIATURIZED STRIP-LINE DIRECTIONAL COUPLER PACKAGE HAVING SPIRALLY WOUND COUPLING LINES

[75] Inventors: Edward S. Caragliano, Poughkeepsie; Howard H. Nick, LaGrangeville, both of N.Y.

[73] Assignee: International Business Machines Corporation, Armonk, N.Y.

[22] Filed: Dec. 23, 1974

[21] Appl. No.: 535,256

[44] Published under the second Trial Voluntary Protest Program on March 23, 1976 as document No. B 535,256.

[52] U.S. Cl. ..... 333/10; 333/84 M

[51] Int. Cl.[2] ..... H01P 5/18

[58] Field of Search ..... 333/10, 84 M

[56] References Cited

UNITED STATES PATENTS

| | | | |
|---|---|---|---|
| 3,164,790 | 1/1965 | Oh | 333/10 |
| 3,407,366 | 10/1968 | Dworkin | 333/10 X |
| 3,551,856 | 12/1970 | Hoffman | 333/10 X |
| 3,629,738 | 12/1971 | Senf | 333/84 M X |

*Primary Examiner*—Paul L. Gensler
*Attorney, Agent, or Firm*—Harold H. Sweeney, Jr.

[57] ABSTRACT

A strip-line directional coupler is provided in which the volumetric size is reduced without a reduction in electrical characteristics. The input and output coupling lines are wound into separate spirals each having the same pitch so that they can be located at a fixed distance with respect to one another which is sufficiently close along their entire length to provide coupling of an input signal from the input coupling line to the output coupling line in the backwards direction. A first and second ground plane is located one on either side of and a small distance from each spirally wound input and output coupling line. A dielectric material is located between the input and output lines and between the ground planes and the input and output lines. The spirally wound input and output coupling lines provide improved electrical characteristics so as to enable a reduction of spacing of the first and second ground planes from either side of the spirally wound input and output coupling lines thereby further diminishing the volumetric size of the device into a small, flat package.

9 Claims, 16 Drawing Figures

NON-SPIRAL VOLUME

SPIRAL VOLUME

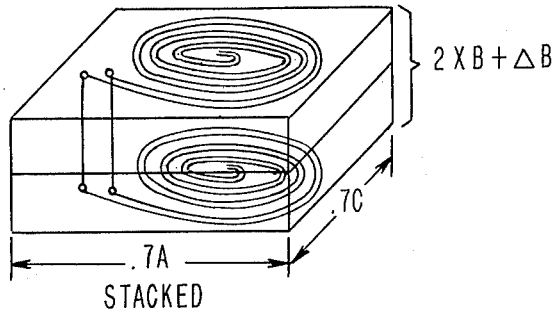
FIG. 9
FIG 10
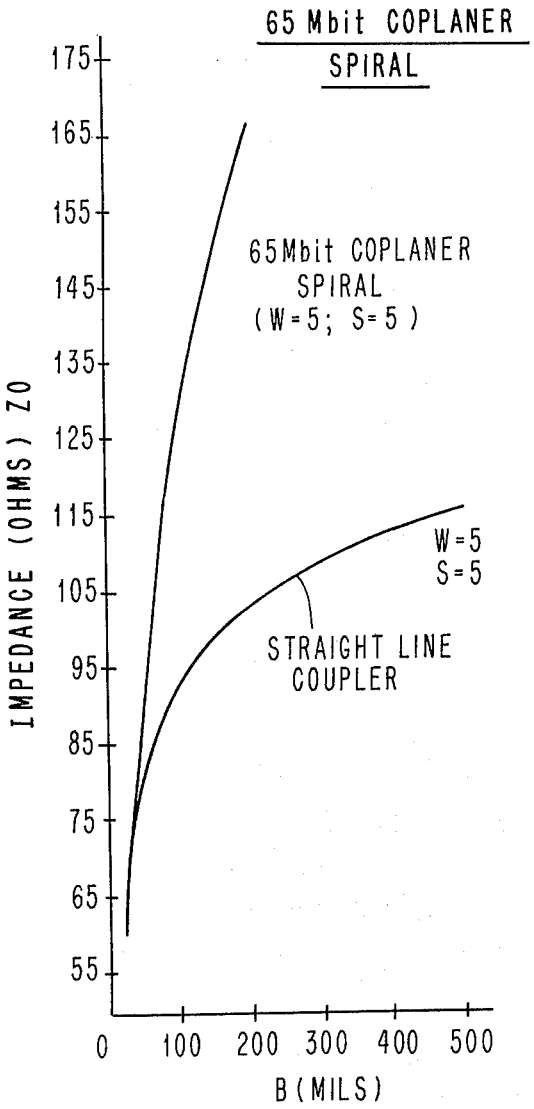
FIG. 11
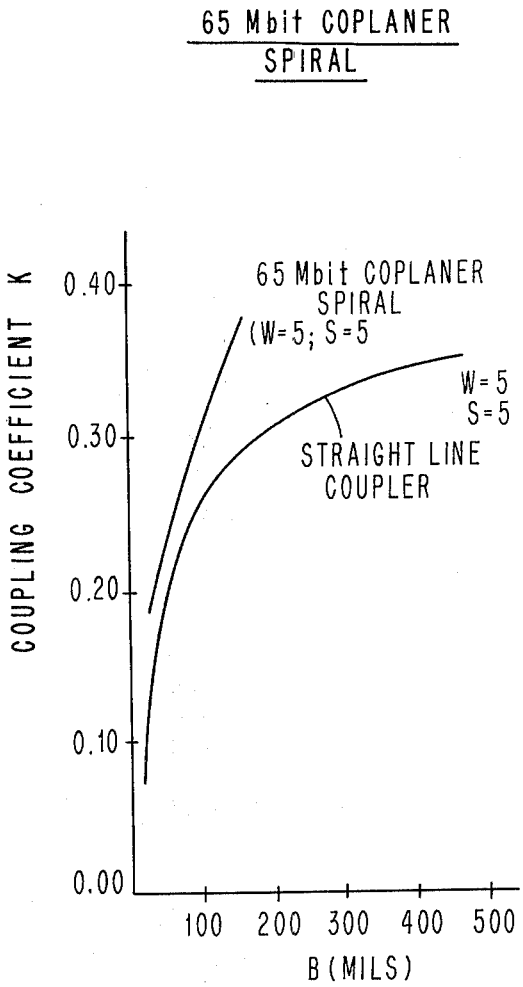

MINIATURIZED STRIP-LINE DIRECTIONAL COUPLER PACKAGE HAVING SPIRALLY WOUND COUPLING LINES

BRIEF STATEMENT OF THE INVENTION

This invention relates to a strip-line directional coupler, and more particularly, to a strip-line directional coupler having improved electrical characteristics enabling a reduction in volumetric size.

BACKGROUND OF THE INVENTION

Discoveries in the field of physics dealing with semiconductor devices has lead to a considerable miniaturization of electronic components and circuitry. Unsuccessful attempts have been made to miniaturize strip-line directional couplers so that they are compatible with other improved electronic components and circuitry. Directional couplers require a rather long package since the coupling between an input line and an output line is usually required over a fairly long distance. In U.S. Pat. No. 3,460,069 an improvement in packaging of directional couplers is set forth in which the coupling lines have a path which winds back and forth between the input and output of the board in a serpentine manner to provide a smaller package. It has been subsequently found that placing the serpentine wound circuit lines closer to further miniaturize the package has caused adverse electrical effects. Actually, the closer spacing of the electrical lines with respect to one another when wound in a serpentine fashion caused a curtailing of the coupling therebetween in adjacent lines. These adjacent lines have electrical signals travelling therethrough in opposite directions and accordingly the coupling tended to detract and hence diminish the electrical characteristics of the coupler.

As is known, the strip-line directional coupler is a device wherein two parallel adjacent printed circuit strip-lines sandwiched between two ground planes are inductively and capacitively coupled so that the edges of a first pulse, of fast rise and fall time characteristics, propagating along one line, produce a positive pulse and a negative pulse in the other line. The lines are back coupled or directional in that the thus produced pulses propagate along the second line in a direction opposite to the direction in which the first pulse propagates along the first line.

The energy transferred between the coupling segments of the two element directional coupler is effected by the various physical characteristics of the directional coupler such as the length, width and distance between the coupling segments. Accordingly, the long coupling element lengths needed to obtain a good energy transfer between the segments of the coupler introduces obvious disadvantages in packaging the two-element directional coupler.

Accordingly, it is an object of the present invention to provide a strip-line directional coupler package having a flat small volumetric size without a consequent reduction in electrical operation.

It is another object of the present invention to provide a strip-line directional coupler package having improved electrical characteristics which enable a reduction in volumetric size.

It is another object of the present invention to provide a strip-line directional coupler in which the electrical characteristics are enhanced while the volumetric size is reduced.

It is a further object of the present invention to provide a strip-line directional coupler package in which the dielectric material and ground planes in a circuit card are also utilized as part of the directional coupler.

BRIEF SUMMARY OF THE INVENTION

A strip-line directional coupler is provided in which the volumetric size is reduced without a reduction in electrical characteristics. The input and output coupling lines are wound in corresponding spirals, each having the same pitch and being located at a fixed distance from one another along their entire length which is sufficiently close to provide coupling of an input signal from the input coupling line to the output coupling line in the backward direction. First and second ground planes are located one on either side of and a small distance from the spirally wound input and output coupling lines. A dielectric material is located between the input and output lines and between the ground planes and the input and output lines. The spirally wound input and output coupling lines provide a smaller package and improved electrical characteristics so as to enable a reduction of spacing of the first and second ground planes from either side of the spirally wound input and output coupling lines thereby further diminishing the volumetric size of the device into a small flat package.

The foregoing and other objects, features and advantages of the invention will be apparent from the following more particular description of a preferred embodiment of the invention, as illustrated in the accompanying drawings.

IN THE DRAWINGS:

FIG. 1 is a schematic diagram of a prior art strip-line directional coupler showing the various terminals and coupling segments thereof.

FIG. 1*a* shows typical waveforms obtained at the various terminals of FIG. 1 when a step input is provided at the input terminal.

FIG. 2 is a schematic diagram portraying the electrical characteristics of the prior art directional coupler shown in FIG. 1.

FIG. 3*a* is a plan view of the directional coupler showing the width of the strip-line utilized.

FIG. 3*b* is a cross-sectional diagram taken along the line 3*b*—3*b* of FIG. 3*a* showing the geometrical arrangement and dimensions of a prior art directional coupler as shown in FIG. 1.

FIG. 4*a* shows a plan view of a spiral wound coplanar directional coupler.

FIG. 4*b* is a cut away view along the line 4B—4B of the directional coupler shown in FIG. 4*a*.

FIG. 5 is a plan view of a directional coupler showing the serpentine winding configuration of the coupling lines.

FIG. 5*a* is a side view of the directional coupler of FIG. 5.

FIG. 6 is a plan view of a broadside directional coupler showing the spiral winding of the input and output lines.

FIG. 6*a* is a side view of the broadside directional coupler of FIG. 6.

FIG. 9 is a schematic diagram showing spiral wound directional coupler packages stacked upon one another.

FIG. 10 is a graphical representation plotting the impedance ZO in ohms versus the B dimension in mils.

FIG. 11 is a graphical representation plotting the coupling coefficient K versus the B dimension in mils.

DESCRIPTION OF THE PREFERRED EMBODIMENTS OF THE INVENTION

Figure 1:
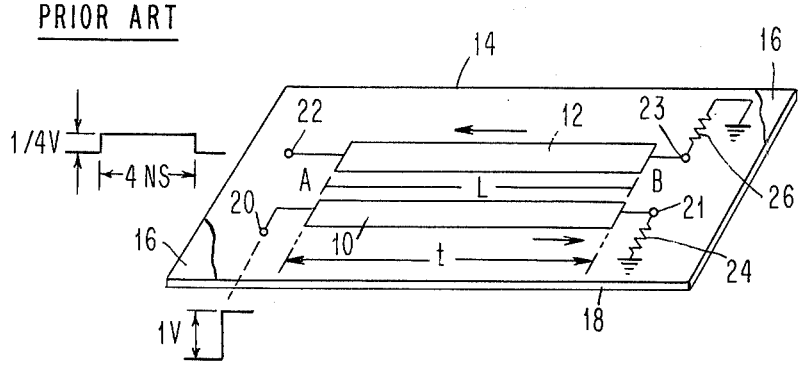
FIG. 1 PRIOR ART

Referring to FIG. 1, there is shown a schematic diagram of the prior art two element directional coupler which consists of the conductive segments 10 and 12 extending parallel to one another from an end A to an end B. Usually, the conductors are mounted on a substrate 14 made of a non-conductive material such as epoxyglass and are arranged between two ground planes 16 and 18 which usually consist of sheets of copper arranged over and under the conductors. Each conductive element 10 and 12 has a terminal 20, 22 at the end A of the coupler serving as an input or output terminal. Each conductor 10, 12 has a terminating resistance 24, 26 connected at the B end of the coupler which matches the coupler to the characteristic impedance of the line to which it is connected. The coupling takes place along the length of the segments 10 and 12. The coupler operation depends upon the steepness of the incident pulse rise and fall time. The width or duration of the pulse produced by the coupling is determined by the length L of the two segments 10, 12 in parallel. The performance of the coupler is related to the impedances offered to signals on the transmission lines and the coupling ratio, which are determined by the width of the lines in the coupled region, the thickness of the lines, the distance between around planes, the spacing between the lines and the relative dielectric constant of the material therebetween. It has been determined that coupling segments of electrical length L will produce a pulse having a time duration equal to 2L. For example, a one volt amplitude input signal applied to the input terminal 20 of segment 10 when the coupler has a coupling ratio of 1 to 4 and an electrical length L of 2ns (nanoseconds), will produce an output pulse having a time duration of 4ns and a pulse amplitude of ¼ volt. The input pulse can be generated by a driver connected to the coupler by a section of transmission line matched to the coupler's impedance.

AS shown in FIG. 1 by arrows, the coupled pulse travels in an opposite direction in the main lines segment 12 to the direction of travel in the coupling segment 10. It will be appreciated, that a pulse travelling along the main transmission line 12 will likewise be coupled to the coupling segment 10 in the opposite direction. A strip-line coupler is operated by the edge of the wave passing along one of the lines and this wave edge should have a rise or fall time that is at least twice as fast as the time duration of the pulse induced in the coupling in order that the relationship of the height of the induced pulse be related to the height of the driving pulse in the manner defined by the coupling ratio K. The electrical length of the coupler is defined as $\tau$ and the coupling co-efficient K = Vout/Vin; where V = voltage.

Figure 1A:
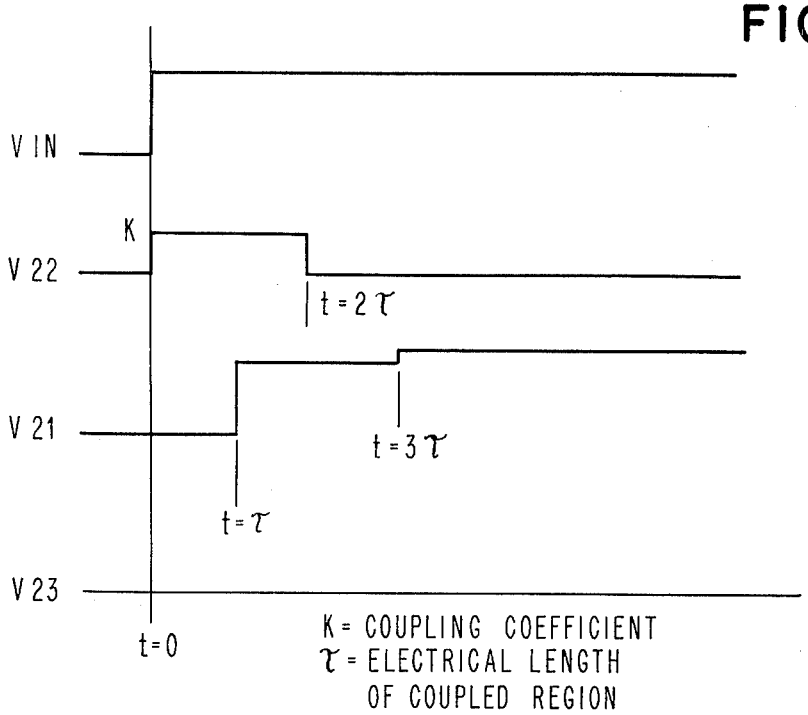

FIG. 1*a* shows the clasical response to a step function input. The input step function applied to terminal 20 is identified in FIG. 1*a* as Vin. The waveform identified as V22 is the waveform obtained at terminal 22 which is the backward coupled signal terminal of the coupler. It can be seen that the amplitude of this pulse is determined by the coupling coefficient K of the coupler and has a duration in time equal to $2\tau$; where $\tau$ is the electrical length of the coupled region. V21 represents the waveform that arrives at the terminal 21 which is known as the thru terminal of the coupler. It will be appreciated that this signal is delayed by a time equal to $\tau$. This delay is the delay encountered in travelling along the coupling line 10 which has an electrical length $\tau$. V23 represents the waveform that would be seen at terminal 23, which is known as the forward terminal of the coupler. This terminal is the so called "null terminal" wherein the resultant coupled energy is zero.

Figure 2:
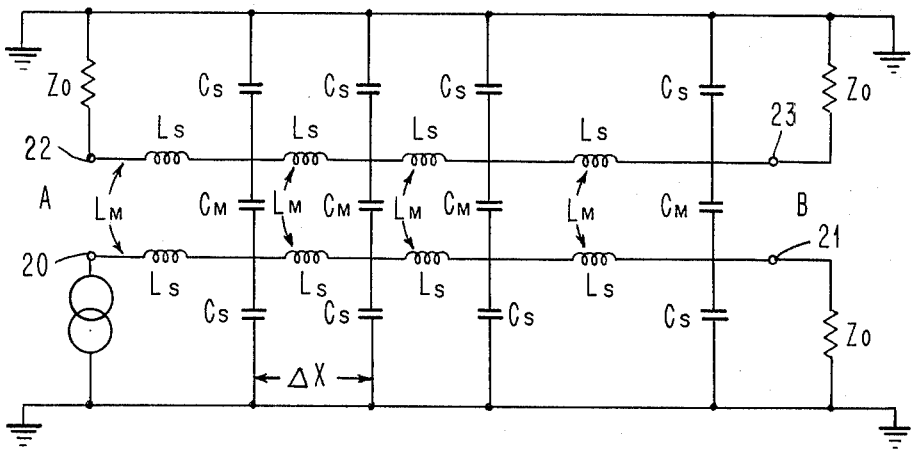
FIG. 2 PRIOR ART
Figure 3A:
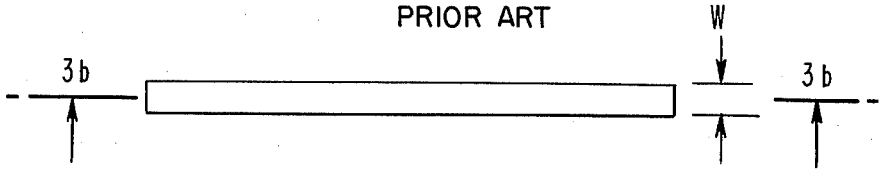
FIG. 3a PRIOR ART
Figure 3B:
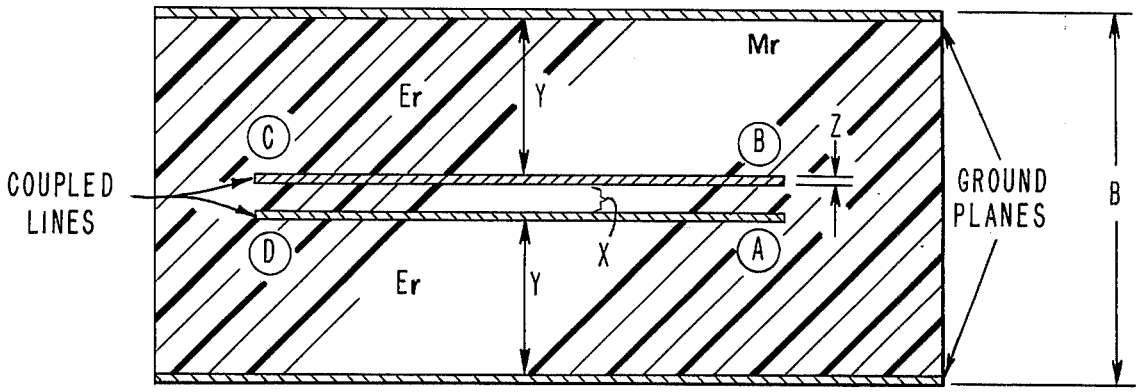
FIG. 3b PRIOR ART

The two transmission lines forming the coupled region are further described by the distributed parameter representation shown in FIG. 2. An incremental length $\Delta X$ is shown which has associated with it the self-inductance of each transmission line Ls, a mutual inductance between the transmission lines Lm, the self-capacitance of each transmission line relative to ground Cs and the mutual capacitance between the lines Cm. The input impedance seen between the input terminal 20 and ground is dependent upon Ls, Lm, Cs, Cm and the terminating impedances Zo. The electrical parameters shown in FIG. 2 are dependent upon the physical geometric parameters of the directional coupler which are depicted in FIG. 3*a* and 3*b* as well as the electro magnetic properties of the surrounding material. FIG. 3*a*, which is a plan view of the directional coupler, shows the width W of the coupled lines. FIG. 3*b* shows the so called broadside directional coupler in cross-section with the following notations:

X = Spacing between lines
Y = Spacing between each line and it's respective ground plane
Z = Thickness of the lines
Er = Relative dielectric constant of the surrounding insulating material
Mr = The relative permeability of the surrounding insulating material The relationship between the electrical parameters and the physical dimensions are obtainable through the manipulation of complex field equations which can be found in the IRE Transactions on Microwave Theory and Techniques: Volume MTT-4, April 1956, pages 75 – 81 by E. M. T. Jones and J. T. Bolljahn, titled "Coupled Strip Transmission Line Filters and Directional Couplers." As can be seen from the reference these equations do not readily lend themselves to a simple notation, however, it is noted that the following parameters are functionally related as follows:

1. Zo (characteristic impedance) = $f(W, Y, X, Z, Er, Mr)$
2. Np (Velocity of Propagation) = $g(c, Er, Mr)$ $c$ being the velocity of light
3. Ls (self inductance) = $h(Mr, Y, Z, W)$
4. Lm (mutual inductance) = $j(Ls, X)$
5. Cs (self capacitance) = $m(Y, W, X, Z, Er)$
6. Cm (mutual capacitance) = $h(W, X, Er, Y, Z)$ The above functions describe the case of two straight parallel circular or rectangular transmission lines spaced in a symmetrical fashion between two semi-infinite ground planes having the region between the ground planes and the lines filled with a homogeneous isotropic media exhibiting some $\mu o$ and EoEr. Where $\mu o$ is the permeability of free space and Eo is the permittivity of the media. The following example is for a straight line directional coupler having the required condition that: k (voltage coupling coefficient) = 0.53

Zo (characteristic impedance) = 100
Er (dielectric constant) = 4.8
W (width of coupling line) = 5.0 mils
$\tau$ (electrical length) = 3.75 n.s.
Z (thickness of line) = 0.7 mils
The resulting geometric configuration is:
X (distance between coupling lines) = 3.14 mils
B (distance between ground planes) = 2y + X = 1327 mils Referring again to FIG. 3*a* and 3*b* a second example is shown having the required conditions as follows:

k = 0.27
Zo = 106
Er = 4.8
W = 25 mils
$\tau$ = 31.25 n.s.
Z = 1.4 mils
The resultant geometric configuration is:
X = 57.2 mils
B = 921 mils It follows from Example 1 that with a dielectric contant of material Er of 4.8 and an electrical length $\tau$ of 3.75 n.s., the length of the coupled region will be approximately equal to 21 inches. Similarly in Example 2 the length of the coupled region will be approximately 168 inches. Of course, the length dimension of any package including the directional coupler will be related to the 21 and 168 inches state above. It will be appreciated that the implementation of the examples would produce a very cumbersome package; i.e., 22 inches × 0.25 inch × 1.3 inches. Any significant attempt to reduce the length dimension of the package will result in a deviation from the straight line case.

Figure 5:
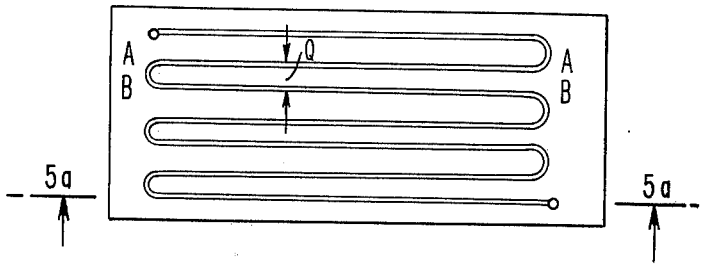
FIG. 5 PRIOR ART
Figure 5A:
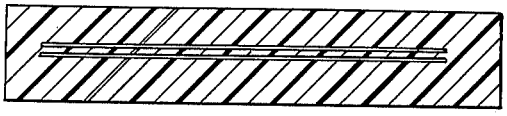
FIG. 5a PRIOR ART

Referring to FIG. 5 and 5a there is shown a broadside coupler having a serpentine configuration of the coupling lines which impacts the previous straight line electrical parameter Ls, Lm, Cs, and Cm. If, for example, the straight line arrangement were bent into the serpentine configuration of FIG. 5, the self inductance of each of the coupled lines and the mutual inductances between the lines would be reduced as compared to the straight line case. For example, the adjacent line segments interact in a manner wherein the current of segment A—A is opposite in direction to that of segment B—B so that the magnetic field produced by the current in segment A—A serves to curtail the field produced by the same current flowing in segment B—B which results in a lower value of self inductance Ls for the entire line. Similarly the output coupling line inductance would be reduced. Accordingly, as the area required for a given length of coupled region is made smaller, the number of straight line segments (A—A), FIG. 5 and their proximity in the serpentine configuration increases, resulting in successive reduction of the self inductances and corresponding mutual inductance. This decrease in self inductance translates direction to a decrease in input impedance Zo as shown in FIG. 2. The change in mutual inductance Lm will have it's major effect on the coefficient of coupling k.

In the straight line coupler arrangement having an impedance Zo, a coupling coefficient *k*, a dielectric constant Er, and a coupling line width and thickness W and Z respectively, the dimensions B, X, and Y as shown in FIG. 3 will be fixed. If this same coupler arrangement is changed to the serpentine configuration, a lower characteristic impedance Zo and a lower coupling coefficient *k* will result. A modification of the Q, B and X dimensions can be made to bring these characteristics Zo and *k* back to the value obtained in the straight line case. The required changes would involve an increase in the Q B dimensions and a decrease in the X dimension.

Figure 6:
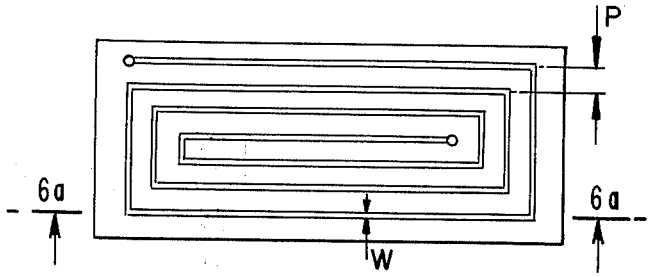
Figure 6A:
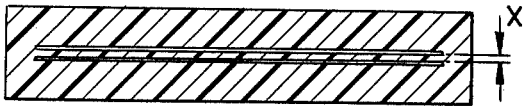

Referring to FIG. 6 and 6*a* there are shown the plan and side view of the broadside directional coupler in which the input coupling line and the output coupling line are spirally wound. Each spiral winding has the same pitch and is arranged in parallel planes so that the width dimension W of the adjacent spirals are opposite and parallel to each other at a distance X throughout their entire length. The spirals are located within a dielectric material which extends out to ground planes, one of which is parallel thereto above the spirals and the other below. The explanation and dimension representations given in connection with FIGS. 3*a* and 3*b* are similarly applicable to the spiral wound directional coupler shown in FIG. 6 and 6*a*. The spiral configuration of the input and output coupling segments or lines affords a considerable reduction of the length dimension with respect to the straight line coupler and affords a much more compact package. In addition, as can be seen from FIGS. 6 and 6*a* the adjacent segments of the windings have the current going in the same direction so that the fields about the current carrying lines tend to aid rather than detract. Actually there is coupling between adjacent lines which is enhanced when the spirals have a small pitch. These improved electrical characteristics are diminished as the ground plane separation B is diminished. Moving the ground planes closer to the spirals tends to limit the field so that there is less adjacent line coupling.

Figure 4A:
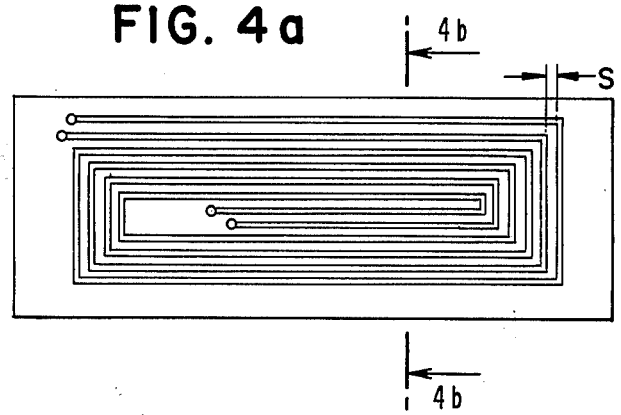
Figure 4B:
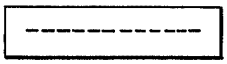

In the case of the coplanar directional coupler, a similar operation takes place. Referring to FIGS. 4*a* and 4*b*, it can be seen that the input and output coupling lines or segments are wound in separate spirals, each having the same pitch. The spirals are located in the same plane slightly offset from one another so that the edges of a line segment of one spiral are separated from the edges of adjacent line segments of the other spiral by a distance S throughout their length. In the spiral wound configuration there is edge coupling from both edges of the input line to adjacent line segments of the output line. As the ground planes are moved closer to the spirals diminishing the dimension B, the field surrounding the input coupling line is intercepted giving a consequent reduction in electrical operation but providing a correspondingly flatter package of smaller volume. The electrical characteristics of the smaller volume spiral wound package are still the equivalent of those of the straight line configuration. In other words diminishing the volume of the package by moving the ground planes closer together diminishes the electrical operation thereby offsetting the increase in electrical operation obtained by the spiral winding of the input and output coupling lines.

It will be shown by the following examples how a spiral configuration, as shown in FIG. 6, provides a drastic reduction of the B dimension, distance between ground planes. Thus, the spiral configuration provides a considerable reduction in volumetric space with respect to the volume required for the straight line case and in addition the spiral configuration provides a considerable reduction in the B dimension so that a relatively flat small volume package results. The following two examples will serve to illustrate the advantage of the spiral concept. The same parameters are utilized in this example as were utilized in Example 1 given above for the straight line directional coupler.

Required Condition:

$k = 0.53$
Zo = 100
Er = 4.8
W = 5 mils
$\tau = 3.75$ n.s.
Z = 0.7 mils
P (Pitch) = 14 mils The pitch is taken from center to center of adjacent windings of the spiral. The resultant geometric configuration is X = 1.43 mils and B = 2Y + X = 100 mils. The B dimension in the straight line case utilizing the same conditions was 1327 mils. This is a difference in B dimension of 1227 mils.

Figure 7:
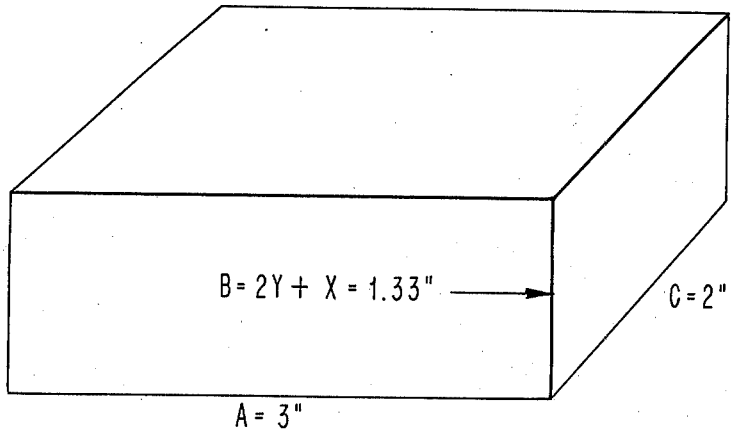
FIG. 7 is a package depicting the size of a non-spiral directional coupler having certain electrical characteristics.
Figure 8:
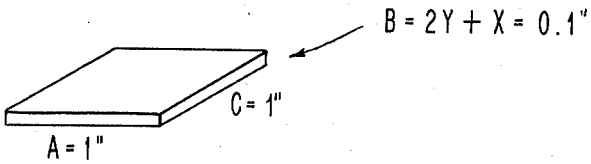
FIG. 8 is a package depicting a spiral wound directional coupler having the same electrical characteristics as the directional coupler providing the package shown in FIG. 7.

The following example is provided having the same required conditions as those given in connection with Example 2 above. The required conditions:

k = 0.27
Zo = 106
Er = 4.8
W = 25 mils
$\tau = 31.25$ n.s.
Z = 1.4 mils
P (Pitch) = 85 mils (25 mil wide lines spaced 60 mils apart) The resultant geometric configuration is:
X = 26.5 mils
B = 126 mils In the straight line case of Example 2 the resulting B dimension was 921 mils. The 126 mils obtained in this example is a considerable reduction from the prior 655 mils. These examples clearly indicate that the spiral winding of the input and output coupling lines provides not only a diminishing of the volume because of the spiral winding of the coupling lines but also provides a diminishing of the distance B between the ground planes, thus giving a second factor which diminishes the volume while still obtaining the same electrical characteristics as the corresponding straight line case. It has been established in the laboratory that the coupling region length of 21 inches arranged in a serpentine configuration will allow the adjacent line segments of the serpentine pattern to be brought to within 250 mils of each other without significantly changing the electrical parameters obtained in the straight line case. The resultant serpentine configuration package size was approximately 3 inches × 1.33 inches × 2 inches as shown in FIG. 7, for a total volume of approximately 8 cubic inches. The equivalent spiral configuration resulted in a package which is approximately 1 inches × 1 inches × 0.1 inch which is 0.1 cubic inch. This is almost a 2 order of magnitude reduction in volume; see FIG. 8. In the spiral configuration of FIG. 8, the area defined by the product of dimensions A and C can be further reduced. This can be done by dividing the total length of the spiral configuration in half, and producing from each half another spiral configuration which could then be connected to one another in a serial fashion and stacked as shown in FIG. 9. This would result in a reduction in area with a corresponding increase in the B dimension, with no adverse effect on the electrical performance of the coupler. Another example to illustrate the area tradeoff achieved in stacking spiral sub-sections is that previously described requiring a coupled region line length of 168 inches. This length corresponds to a directional coupler tuned ¼ wavelength to 8 MHZ. The dimensions of such a coupler in the non-stacked spiral configuration are 4.5 inches × 4.5 inches × 0.12 inch. If the spiral length were to be divided in half and the two halves stacked, the resulting package dimensions would be 3.2 inches × 3.2 inches × 0.24 inch. If the line segments were divided into three equal parts and subsequently stacked, the resulting dimensions would be 2.7 inches × 2.7 inches × 0.36 inch. Again, in this example the electrical performance is not affected.

The effect of changes in the B dimension, spacing between the ground planes, can best be seen in the graphs of FIGS. 10 and 11, where FIG. 10 is a plot of the characteristic impedance Zo versus the B dimension for a 65 megabit coplanar spiral directional coupler. As described above the coplanar spiral is one wherein the input coupling line spiral and the output coupling line spiral have the same geometrical characteristics of line, width and thickness and also the same spiral pitch. The spirals are interleaved and closely spaced with respect to one another over the entire length of the coupling line in the coupling region. Thus, the input coupling lines and the output coupling lines are located in the same plane. In the example plotted in FIGS. 10 and 11 the line coupling width is equal to 5 mils and the distance S is equal to 5 mils. The distance S is the distance that one spiral is spaced from the other spiral along it's coupling length. In the case of the straight line coplaner coupler the S distance is the distance between the edge of the input coupling line and the edge of the output coupling line. Looking at the graph of FIG. 10 it can be seen in the straight line coupler situation that large changes in the B dimension produce very small changes in the impedance. However, in the coplanar spiral plot, it can be seen that small changes in the B dimension produce large changes in the impedance of the coupler. This can best be appreciated from an example such as an impedance Zo of 115 ohms. It can be seen that a B dimension of about 80 mils is required in the case of the coplanar spiral as plotted in FIG. 10. To obtain the same impedance of 115 ohms in the case of a straight line coupler requires approximately a B dimension of 450 mils. From this it can be seen that the spiral winding of the input and output coupler lines can drastically reduce the B dimension required and thus reduce the overall volumetric package without effecting the electrical characteristics.

Similarly, FIG. 11 shows a plot of the coupling coefficient k versus the B dimension for a 65 megabit coplanar spiral directional coupler having 5 mil wide lines with a spacing S of 5 mils. The pitch of the spirals used in this case is 20 mils. Comparing the B dimension for the spiral coupler and the straight line coupler for a coupling coefficient of approximately 0.25 it can be seen that the spiral coupler requires a B dimension of approximately 150 mils while the straight line coupler requires a B dimension of approximately 450 mils. This is a considerable reduction in the B dimension for a given coupling coefficient k.

Clearly the implementation of the spiral configuration allows for a dramatic reduction in the package volume for a low frequency directional coupler.

While the invention has been particularly shown and described with reference to preferred embodiments thereof, it will be understood by those skilled in the art that the various changes in form and detail may be made therein without departing from the spirit and scope of the invention.

What is claimed is.

1. A strip-line directional coupler having a smaller volumetric size without a consequent reduction in electrical operation comprising;

an input coupling line wound in a small pitch planar spiral;

an output coupling line wound in a planar spiral having the same pitch as the spiral of said input coupling line so that said input and output coupling lines can be located at a fixed distance which is sufficiently close to one another along their entire length to provide coupling of an input signal from the input coupling line to the output coupling line in the backward direction;

a first and second ground plane located one on either side of a small distance from said spirally wound input and output coupling lines;

a dielectric material located between said input and output lines and between said ground planes and said input and output lines;

the spirally wound input and output coupling lines having sufficiently small pitch to provide electromagnetic coupling between adjacent windings of the spirals to obtain improved electrical characteristics so as to enable a reduction of spacing of said first and second ground planes from either side of said spirally wound input and output coupling lines thereby offsetting the improved electrical characteristics and, thereby further diminishing the volumetric size of said device into a small flat package.

2. A strip-line directional coupler according to claim 1, wherein said first and second ground planes are spaced at a minimum distance from their respective spiral so as to obtain the desired electrical characteristics for the given geometric characteristics.

3. A strip-line directional coupler according to claim 1, wherein said input and output coupling line spirals each have a sufficiently small pitch so that the self inductance is enhanced by coupling between the adjacent segments of the respective spirals.

4. A strip-line directional coupler according to claim 1, wherein said dielectric material located between said input and output lines and between said ground planes and said input and output lines is part of the dielectric material of a circuit card and wherein said first and second ground planes located one on either side and a small distance from said spirally wound input and output coupling lines are also the ground planes of the circuit card.

5. A strip-line directional coupler according to claim 1, wherein said input coupling line spiral and said output coupling line spiral having the same pitch are spaced a fixed distance from one another in closely spaced parallel planes, the input coupling line of said input coupling line spiral and the output coupling line of said output coupling line spiral being in exact registration throughout the entire spiral.

6. A strip-line directional coupler according to claim 5, wherein the input coupling line of said input spiral and the output coupling of said output coupling line spiral have a fixed width W which lies in their respective planes, the registration being such that the spirals of said input and output coupling lines are broadside to one another.

7. A strip-line directional coupler according to claim 1, wherein said input coupling line spiral and said output coupling line spiral having the same pitch have the respective coupling lines thereof interleaved so that the respective coupling lines are located in the same plane adjacent to one another at a fixed distance throughout the spirals.

8. A strip-line directional coupler according to claim 1, wherein the respective coupling lines of said respective input and output coupling lines spiral have a fixed width W and a fixed thickness T, the width W lying in the same plane with the thickness edges being spaced from one another said fixed distance throughout said respective spiral forming a coplanar coupling.

9. A strip-line directional coupler according to claim 7, wherein said input coupling line spiral and said output coupling line spiral have the same small pitch and are interleaved and located sufficiently close to one another in the same plane along their entire length such that the input coupling line provides edge coupling to adjacent output coupling line segments from both edges thereby enhancing the electrical characteristics of said coupler.

* * * * *